US010927487B2

(12) United States Patent
Bockos et al.

(10) Patent No.: US 10,927,487 B2
(45) Date of Patent: Feb. 23, 2021

(54) LAUNDRY WASHING MACHINE PROVIDED WITH A CONTROL PANEL

(71) Applicant: Electrolux Appliances Aktiebolag, Stockholm (SE)

(72) Inventors: Giancarlo Bockos, Verona (IT); Vittorio Cascianelli, Charlotte, NC (US)

(73) Assignee: Electrolux Appliances Aktiebolag, Stockholm (SE)

( * ) Notice: Subject to any disclaimer, the term of this patent is extended or adjusted under 35 U.S.C. 154(b) by 195 days.

(21) Appl. No.: 16/063,861

(22) PCT Filed: Dec. 22, 2016

(86) PCT No.: PCT/EP2016/082335
§ 371 (c)(1),
(2) Date: Jun. 19, 2018

(87) PCT Pub. No.: WO2017/114740
PCT Pub. Date: Jul. 6, 2017

(65) Prior Publication Data

US 2020/0032446 A1 Jan. 30, 2020

(30) Foreign Application Priority Data

Dec. 29, 2015 (EP) ..... 15202862

(51) Int. Cl.
*D06F 34/28* (2020.01)
*D06F 39/02* (2006.01)

(52) U.S. Cl.
CPC ..... *D06F 34/28* (2020.02); *D06F 39/02* (2013.01); *D06F 39/022* (2013.01); *D06F 2216/00* (2013.01)

(58) Field of Classification Search
CPC ..... D06F 34/28; D06F 39/02; D06F 39/022; D06F 2216/00
See application file for complete search history.

(56) References Cited

U.S. PATENT DOCUMENTS 3,301,022 A * 1/1967 Low ..... D06F 39/08 68/12.18
5,262,132 A * 11/1993 Bricker ..... A47L 15/4409 134/93

(Continued)

FOREIGN PATENT DOCUMENTS

DE 3238540 A1 4/1984
DE 3302893 A1 8/1984

(Continued)

OTHER PUBLICATIONS

International Search Report and Written Opinion for International Application No. PCT/EP2016/082335, dated Feb. 10, 2017, 13 pages.

(Continued)

*Primary Examiner* — Joseph L. Perrin
(74) *Attorney, Agent, or Firm* — RatnerPrestia

(57) ABSTRACT

A laundry washing machine equipped with a treating agents dispenser comprising compartments adapted to be filled with at least one treating agent and a control panel comprising at least one first input device operable by the user to select a washing program and at least one second input device operable by the user to select an option for the selected washing program which implies the use of an additional treating agent which has to be inserted in a dedicated compartment. The control panel further comprises first output devices informing the user of the selectable washing program and at least one second output device informing the user of the selectable option for the washing program. At (Continued)

least one of said first output devices and said at least one second output device comprise a common visual identifier.

9 Claims, 7 Drawing Sheets

(56) References Cited

U.S. PATENT DOCUMENTS

| | | | | |
|---|---|---|---|---|
| 6,434,977 | B1 | 8/2002 | Hapke et al. | |
| 2006/0272360 | A1 | 12/2006 | Hsu et al. | |
| 2007/0241938 | A1* | 10/2007 | Ulius-Sabel | D06F 34/28 341/22 |
| 2008/0276382 | A1* | 11/2008 | Benne | D06F 34/28 8/158 |
| 2009/0095028 | A1* | 4/2009 | Hoppe | D06F 34/28 68/12.04 |
| 2010/0000022 | A1* | 1/2010 | Hendrickson | D06F 39/028 8/137 |
| 2010/0000023 | A1* | 1/2010 | McAllister | D06F 34/28 8/137 |
| 2010/0000025 | A1* | 1/2010 | Dalton | A47L 15/44 8/137 |
| 2010/0000578 | A1 | 1/2010 | Hendrickson et al. | |
| 2010/0000581 | A1* | 1/2010 | Doyle | D06F 39/02 134/99.2 |
| 2011/0173536 | A1 | 7/2011 | Payne et al. | |
| 2011/0302533 | A1 | 12/2011 | Stuhr et al. | |
| 2013/0098450 | A1 | 4/2013 | Frantz | |
| 2013/0290902 | A1* | 10/2013 | Martin | D06F 34/28 715/823 |
| 2017/0022651 | A1* | 1/2017 | Bilancio | G06F 3/04847 |

FOREIGN PATENT DOCUMENTS

| | | | |
|---|---|---|---|
| DE | 102009011678 | A1 | 8/2010 |
| DE | 102011078471 | A1 | 1/2013 |
| EP | 1847643 | A2 | 10/2007 |
| WO | 2004109005 | A1 | 12/2004 |
| WO | 2013068886 | A1 | 5/2013 |
| WO | 2016146321 | A1 | 9/2016 |

OTHER PUBLICATIONS

International Search Report and Written Opinion for International Application No. PCT/EP2016/082326, dated Feb. 2, 2017, 10 pages.

Non Final Office Action for U.S. Appl. No. 16/063,851, dated Mar. 16, 2020, 13 pages.

USPTO Final Office Action issued in U.S. Appl. No. 16/063,851, dated Jun. 17, 2020, 15 pages.

USPTO Non Final Office Action issued in U.S. Appl. No. 16/063,851, dated Oct. 8, 2020, 18 pages.

USPTO Final Office Action issued in U.S. Appl. No. 16/063,851, dated Jan. 12, 2021, 14 pages.

* cited by examiner

LAUNDRY WASHING MACHINE PROVIDED WITH A CONTROL PANEL

This application is a US. National Phase application of PCT International Application No. PCT/EP2016/082335, filed Dec. 22, 2016, which claims the benefit of European Application No, 15202862.7, filed Dec. 29, 2015, both of which are incorporated by reference herein.

The present invention concerns the field of laundry washing techniques.

In particular, the present invention refers to a laundry washing machine equipped with an improved control panel.

BACKGROUND ART

Nowadays the use of laundry washing machines, both "simple" laundry washing machines (i.e. laundry washing machines which can only wash and rinse laundry) and laundry washing-drying machines (i.e. laundry washing machines which can also dry laundry), is widespread.

In the present description the term "laundry washing machine" will refer to both simple laundry washing machines and laundry washing-drying machines.

Laundry washing machines generally comprise an external casing, or cabinet, provided with a washing tub which contains a rotatable perforated drum where the laundry is placed. A loading/unloading door ensures access to the drum.

Laundry washing machines typically comprise a water supply unit and a products supply unit, or dispenser, for the introduction of water and treating agents (i.e. detergent, softener, rinse conditioner, etc.) into the tub. The treating agents dispenser is advantageously connected to a water source (water mains).

Known treating agents dispensers comprise one or more compartments adapted to be filled with at least one treating agent.

The treating agents dispenser is generally located inside the cabinet, immediately above the washing tub, and is structured for selectively feeding into the washing tub, according to the washing program manually-selected by the user via a control panel generally located on the front wall of the cabinet, a given amount of detergent, softener and/or other washing agent suitably mixed with fresh water arriving from the water mains; and with a fresh-water supply circuit structured for selectively drawing fresh water from the water mains according to the washing program manually-selected by the user, and channeling said water into the treating agents dispenser or directly into the washing tub.

The treating agents dispenser, in turn, generally comprises a detergent drawer which is usually divided into a number of detergent compartments each structured for being manually fillable with a corresponding treating agent, and which is fitted/inserted in manually extractable manner into a completely recessed drawer housing whose entrance is located on front wall of the cabinet, above the door, and whose bottom wall preferably directly communicates with the inside of the washing tub via a connecting duct.

Known laundry washing machines are usually provided with a user interface comprising a dashboard or control panel with input devices such as touch sensitive input devices knobs, buttons, etc., allowing the user to select or set washing and/or drying programs or allowing the user to select or set washing and/or drying options for the specific selected program. The control panels are typically provided also with output devices such as LEDs, displays, alphanumeric displays, warning lights, icons, texts etc. for giving information to the user of the features of the machine and/or a feedback to the user related to the settings/status of the machine.

Laundry washing machines of known type are characterized by a great number of washing programs and also by a great number of program options.

For example, it is also possible to chose among various washing programs to suit the needs of every user such as: cotton, wool, silk, delicate, synthetic, jeans, or heavy duty, whitest whites, etc.

Furthermore, it is possible to chose among various program options to suit the needs of every user such as: washing water temperature (hot, worm, cold, . . . ), soil level (heavy, normal, light, . . . ), spin speed (high, medium, low, . . . ), stain treat, extra rinse, time settings, etc.

It is also known that each washing program and its options provides for filling one or more compartments of the dispenser with corresponding treating agents.

For example, "heavy duty" program needs detergent in the main wash compartment and optionally softener and/or bleach in the respective compartment; a washing program including a stain treatment option provides for a stain remover in a respective compartment.

The laundry washing machines of the known art pose some drawbacks.

A drawback posed by known laundry washing machines is the difficulty for the user to prepare the machine with the treating agents according to the washing program and/or options selected, due to the great number of combinations resulting from the program and options available.

This induce the user to continuously consult the user manual or even cause to fill the wrong compartment and/or to use the wrong treating agent.

Furthermore, complexity due to the great number of combinations leads the user to use substantially only the same program for any kind of load, which makes he/she the life easier but does not take advantage of efficiency deriving from the great availability of programs/options of the laundry washing machine.

The object of the present invention is therefore to overcome the drawbacks posed by the known techniques.

It is an object of the invention to provide a laundry washing machine with features that improves the usability of laundry washing machine for users.

It is another object of the invention to provide a laundry washing machine with features that allows exploiting the potential and efficiency of the laundry washing machine.

DISCLOSURE OF INVENTION

The applicant has found that by providing a laundry washing machine comprising a treating agents dispenser having compartments for the treating agents and a control panel comprising input devices allowing the user to select or set washing programs and/or option for the washing program and first output devices informing the user of the selectable washing program and a second output device informing the user of a selectable option for the washing program and wherein at least one of said first output devices and said second output device comprise a common visual identifier, it is possible to improve the usability of the laundry washing machine compared to known systems.

The present invention relates, therefore, to a laundry washing machine connectable to a water mains comprising:

- a cabinet supporting a washing drum adapted to receive laundry and a washing tub external to said washing drum;

a treating agents dispenser connectable to said water mains and comprising compartments adapted to be filled with at least one treating agent;

a supply line, fluidly connecting said treating agents dispenser and said washing tub;

a control panel comprising at least one first input device operable by the user to select a washing program, at least one second input device operable by the user to select an option for the selected washing program which implies the use of an additional treating agent which has to be inserted in a dedicated compartment of said compartments, first output devices informing the user of the selectable washing program and at least one second output device informing the user of the selectable option for the washing program;

a control unit for controlling functioning of said laundry washing machine; wherein at least one of said first output devices and said at least one second output device comprise a common visual identifier.

Preferably, at least one of said first output devices comprises a first visual identifier and said at least one second output device comprises a second visual identifier and said first visual identifier and said second visual identifier have the same colouring.

In a preferred embodiment of the invention, also the dedicated compartment comprises said common visual identifier.

Preferably, said dedicated compartment comprises a third visual identifier, wherein the first visual identifier, the second visual identifier and the third visual identifier have the same colouring.

According to a preferred embodiment of the invention, two or more of the first output devices comprises the first visual identifier.

Preferably, the first visual identifier differs from visual identifiers of other first output devices.

Also preferably, the second visual identifier differs from visual identifiers of other second output devices.

Also preferably, the third visual identifier differs from visual identifiers of other compartments.

In a preferred embodiment of the invention, said colouring comprises a colour. Alternatively, said colouring comprises a combination of colours.

According to a preferred embodiment of the invention, said option for the washing program provides for that a stain treatment phase is performed and that the treating agent which is inserted into the dedicated compartment is a stain remover.

In a preferred embodiment of the invention, said washing program provides for that a pre-wash phase is performed and that a dose of detergent is inserted into the dedicated compartment if the option for the selected washing is not selected. Preferably, said first output devices or said at least one second output device comprises one or more of the elements of the group comprising: alphanumeric, texts, lines, images, icons, lights, LEDs displays, alphanumeric displays or a combination thereof.

In a second aspect thereof, the present invention concerns a method for preparing the laundry washing machine above described, the method comprising the steps of:

selecting a washing program by means of said at least one first input device;

selecting an option for said washing program by means of said at least one second input device; and inserting an additional treating agent in said dedicated compartment if said washing program and said option are both associated to said common visual identifier.

In a preferred embodiment of the invention, the step of inserting an additional treating agent in the dedicated compartment is carried out after the steps of selecting a washing program and of selecting an option for the washing program.

In a further preferred embodiment of the invention, the step of inserting an additional treating agent in the dedicated compartment is carried out before the steps of selecting a washing program and of selecting an option for the washing program.

According to a preferred embodiment of the invention, the option for the washing program comprises a stain treatment phase and the additional treating agent comprises a stain remover.

Preferably, the method further comprises a step of introducing a laundry load in the washing drum.

Preferably, the method further comprises a step of starting the washing program.

In a third aspect thereof, the present invention concerns a method for preparing the laundry washing machine above described, the method comprising the steps of:

selecting a washing program by means of said at least one first input device;

selecting an option for said washing program by means of said at least one second input device; and inserting a first treating agent different from said additional treating agent in said dedicated compartment if said washing program and said option are not both associated to said common visual identifier.

In a preferred embodiment of the invention, the step of inserting the first treating agent in the dedicated compartment is carried out after the steps of selecting a washing program and of selecting an option for the washing program.

In a further preferred embodiment of the invention, the step of inserting the first treating agent in the dedicated compartment is carried out before the steps of selecting a washing program and of selecting an option for the washing program.

According to a preferred embodiment of the invention, the washing program comprises a pre-wash phase and the first treating agent comprises detergent.

Preferably, the method further comprises a step of introducing a laundry load in the washing drum.

Preferably, the method further comprises a step of starting the washing program.

In a fourth aspect thereof, the present invention concerns the use of the laundry washing machine above described, the use comprising the steps of:

selecting a washing program by means of said at least one first input device;

selecting an option for said washing program by means of said at least one second input device; and inserting an additional treating agent in said dedicated compartment if said washing program and said selected option are both associated to said common visual identifier.

In a preferred embodiment of the invention, the step of inserting an additional treating agent in the dedicated compartment is carried out after the steps of selecting a washing program and of selecting an option for the washing program.

In a further preferred embodiment of the invention, the step of inserting an additional treating agent in the dedicated compartment is carried out before the steps of selecting a washing program and of selecting an option for the washing program.

In a preferred embodiment of the invention, the option for the washing program comprises a stain treatment phase and the additional treating agent comprises a stain remover.

Preferably, the method further comprises a step of introducing a laundry load in the washing drum.

Preferably, the method further comprises a step of starting the washing program.

In a fifth aspect thereof, the present invention concerns the use of the laundry washing machine above described, the use comprising the steps of:

selecting a washing program by means of said at least one first input device;

selecting an option for said washing program by means of said at least one second input device; and inserting a first treating agent different from said additional treating agent in said dedicated compartment if said washing program and said option are not both associated to said common visual identifier.

In a preferred embodiment of the invention, the step of inserting the first treating agent in the dedicated compartment is carried out after the steps of selecting a washing program and of selecting an option for the washing program.

In a further preferred embodiment of the invention, the step of inserting the first treating agent in the dedicated compartment is carried out before the steps of selecting a washing program and of selecting an option for the washing program.

Preferably, the washing program comprises a pre-wash phase and the first treating agent comprises detergent.

Preferably, the method further comprises a step of introducing a laundry load in the washing drum.

Preferably, the method further comprises a step of starting the washing program.

BRIEF DESCRIPTION OF THE DRAWINGS

Further characteristics and advantages of the present invention will be highlighted in greater detail in the following detailed description of preferred embodiments of the invention, provided with reference to the enclosed drawings. In the drawings, corresponding characteristics and/or components are identified by the same reference numbers. In such drawings.

DETAILED DESCRIPTION OF THE INVENTION

Figure 2:
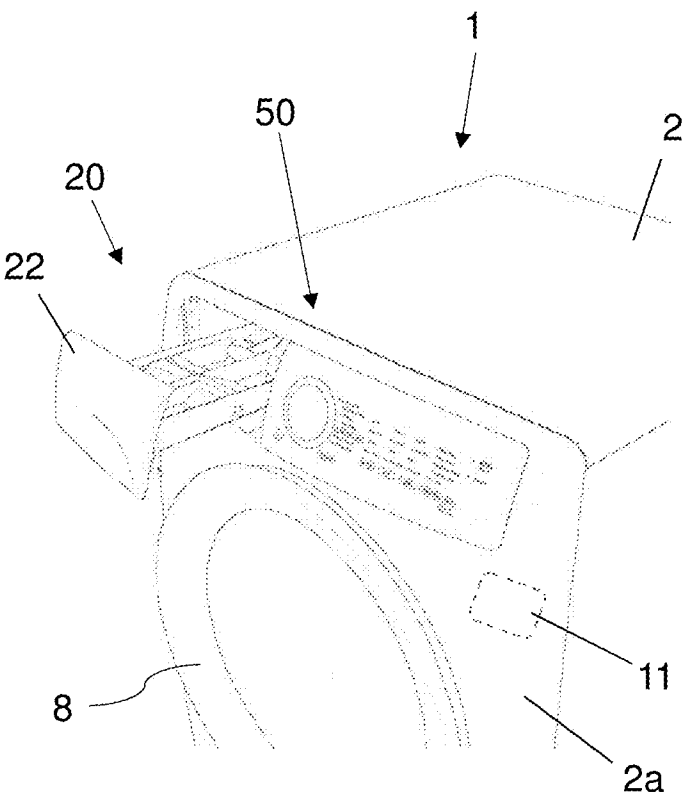
FIG. 2 is a partial view of the laundry washing machine of the FIG. 1 with the drawer in its opened position.

The present invention has proved to be particularly advantageous when applied to laundry washing machines, as described below. It should in any case be underlined that the present invention is not limited to laundry washing machines. On the contrary, the present invention can be conveniently applied to laundry washing-drying machines (i.e. laundry washing machines which can also dry laundry).

In the present description, therefore, the term "laundry washing machine" will refer to both simple laundry washing machines and laundry washing-drying machines. With reference to Figures from 1 to 3 a laundry washing machine 1 according to a preferred embodiment of the invention is described.

The laundry washing machine 1 comprises an external casing or cabinet 2, in which a washing tub, not visible, is provided that contains a perforated washing drum, not visible, where the laundry to be treated can be loaded.

The tub and the drum both preferably have a substantially cylindrical shape.

The cabinet 2 is provided with a loading/unloading door 8 which allows access to the drum.

The tub is preferably suspended in a floating manner inside the cabinet 2, advantageously by means of a number of coil springs and shock-absorbers, not illustrated.

The drum is advantageously rotated by an electric motor, not illustrated, which preferably transmits the rotating motion to the shaft of the drum, advantageously by means of a belt/pulley system. In a different embodiment of the invention, the motor can be directly associated with the shaft of the drum.

The drum is advantageously provided with holes which allow the liquid flowing therethrough. Said holes are typically and preferably homogeneously distributed on the cylindrical side wall of the drum.

Laundry washing machine 1 advantageously comprises a control unit 11 connected to the various parts of the laundry washing machine 1 in order to ensure its operation.

The laundry washing machine 1 preferably comprises a treating agents dispenser 20 which is housed inside the casing 2 in easily reachable manner by the user, and is structured for selectively feeding into the washing tub, according to the selected washing program, a given amount of detergent, softener and/or other treating agent suitably mixed with the fresh water arriving from the water mains, or even simply a given amount of fresh water arriving from the water mains. A fresh-water supply circuit is structured for being connectable to the water mains and for selectively channeling the fresh water from the water mains to the treating agents dispenser 20 and/or directly to the washing tub preferably while controlling/regulating the flow of fresh water towards the treating agents dispenser 20 and/or the washing tub.

The treating agents dispenser 20 preferably comprises a removable drawer 22 connected to the frontal side wall 2*a* of the cabinet 2, opportunely in an upper region of the latter, positioned above the tub.

Figure 1:
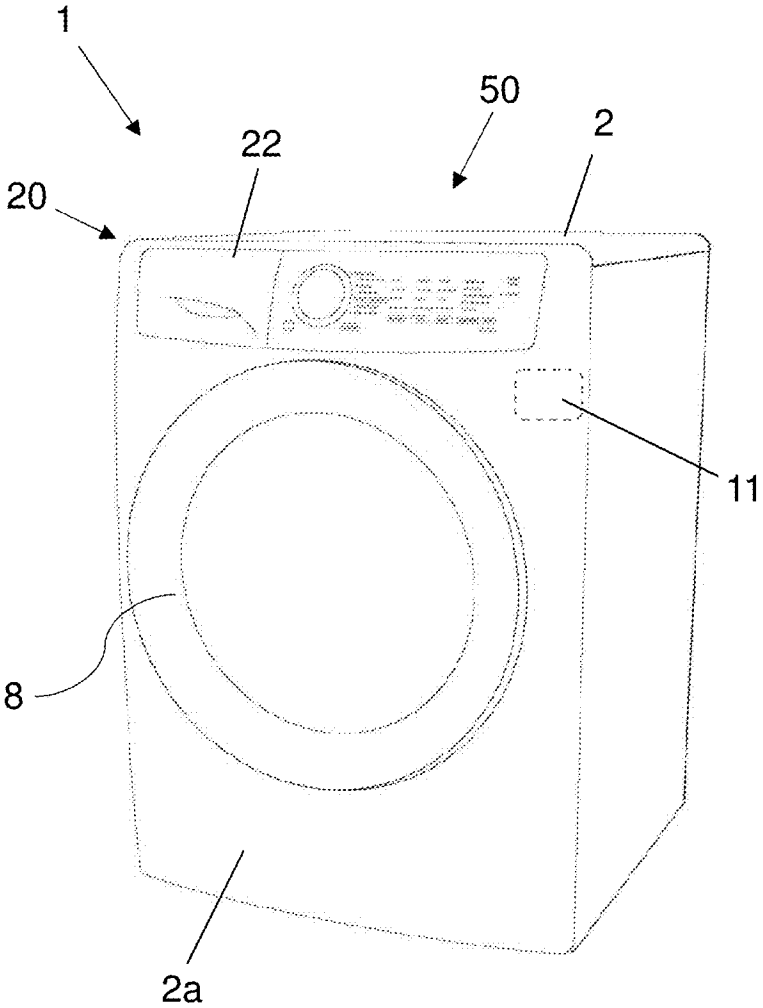
FIG. 1 is a perspective view of a front-loading, home laundry washing machine according to a preferred embodiment of the present invention.
Figure 3:
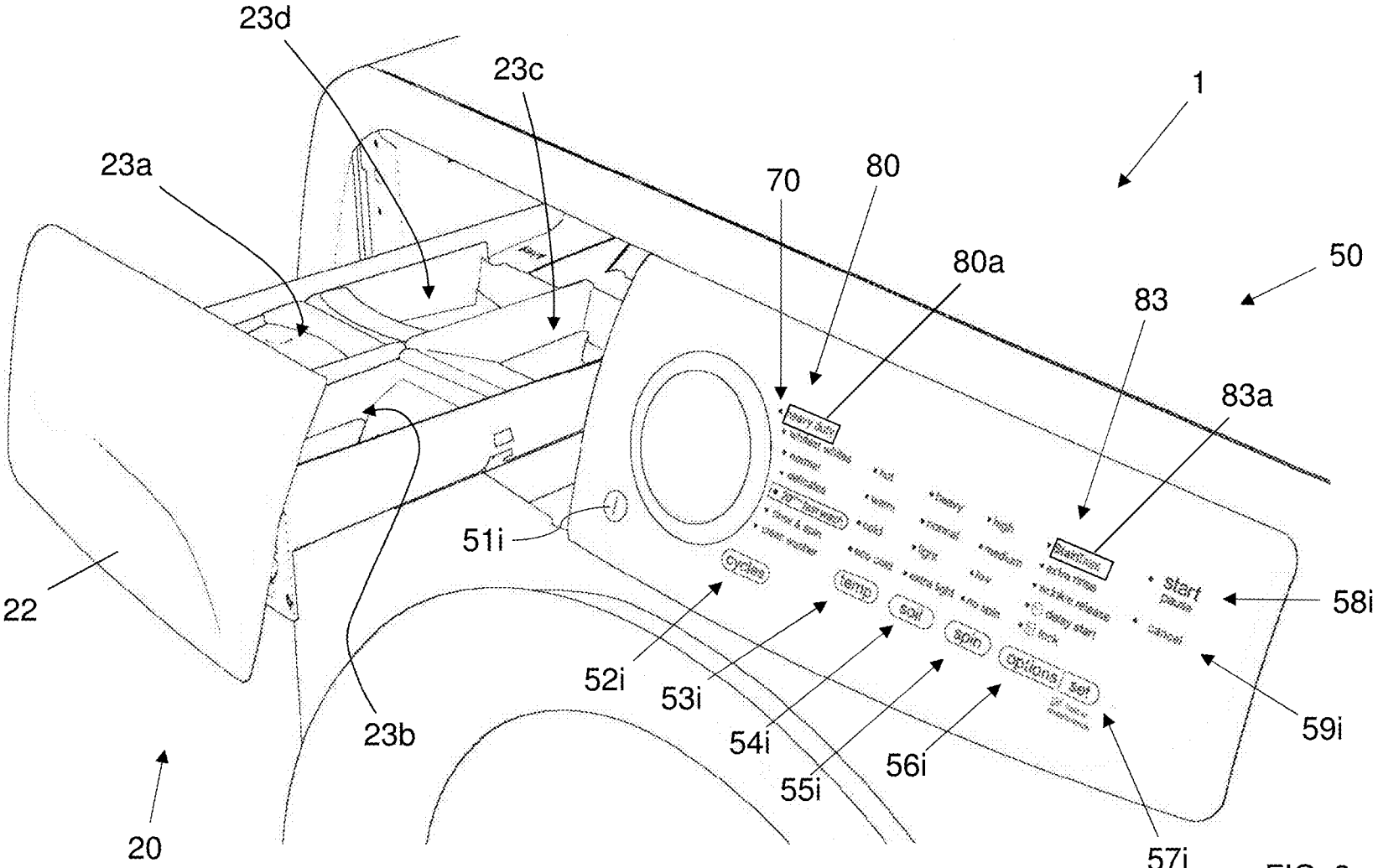
FIG. 3 is an enlarged view of a particular of FIG. 2.

The removable drawer 22 can be extracted from the frontal side wall 2*a* such as to protrude from the cabinet 2 in an opened loading position easily accessible by the user, as illustrated for example in FIGS. 2 and 3, or can be fully inserted in an operative position, as illustrated for example in FIG. 1.

The drawer 22 is preferably provided with one or more compartments 23*a*, 23*b*, 23*c*, 23*d* having bottom and side walls adapted to be filled with treating agents.

In the embodiment illustrated in the Figures, there are four compartments, 23*a*, 23*b*, 23*c* and 23*d*.

In different embodiments, the number of compartments may be different, according to the desired type and/or number of treating agents which are used in the particular model of laundry washing machine.

The first compartment 23*a* is preferably adapted for receiving a powder or a liquid detergent for the main wash. The second compartment 23*b* is preferably adapted for receiving a softener. The third compartment 23*c* is preferably adapted for receiving bleach. The fourth compartment

23*d* is preferably adapted for receiving another treating agent, in particular a stain remover, as will better explained later.

The first compartment 23*a* is then preferably marked with the text "main wash", the second compartment 23*b* is preferably marked with the softener symbol and the text "liquid softener" and the third compartment 23*c* is preferably marked with the bleach symbol and the text "liquid bleach".

Laundry washing machine 1 preferably comprises an interface unit 50, or control panel, connected to the control unit 11, accessible to the user and by means of which the user may select or set washing programs or he/she may select or set washing options for the specific selected washing program.

In case of a laundry washing-drying machine, the user may also select or set drying programs and/or drying options for the specific selected drying program.

The control panel 50 comprises input devices by means of which the user selects or sets the washing programs and/or selects or sets washing options for a specific washing program.

The input devices of the preferred embodiment illustrated and described herein preferably comprise an on-off push button 51*i*, a washing program selection button 52*i*, a temperature selection button 53*i*, a soil level selection button 54*i*, a spin speed selection button 55*i*, an options selection button 56*i*, a set button 57*i*, a start/pause button 58*i* and a cancel button 59*i*.

The on-off push button 51*i* is used to switch on and off the laundry washing machine 1.

The washing program selection button 52*i* is used to select the desired washing program among seven washing programs, preferably "heavy duty", "whitest whites", "normal", "delicates", "20 min fast wash", "rinse & spin" and "clean washer".

In different embodiments, a rotary knob may be advantageously used instead of the washing program selection button 52*i*.

The temperature selection button 53*i* is used to select the desired washing water temperature for the washing program selected though the washing program selection button 52*i*. The temperature selection button 53*i* allows the selection of the washing water temperature preferably among four levels, preferably "hot", "warm", "cold" and "eco cold".

The soil level selection button 54*i* is used to select the soil level of the laundry, preferably "heavy", "normal", "light" and "extra light".

The spin speed selection button 55*i* is used to select the desired spin speed for the washing program selected though the washing program selection button 52*i*. The spin speed selection button 55*i* allows the selection of the speed preferably among four levels, preferably "high", "medium", "low" and "no spin".

The options selection button 56*i* is used to select the desired option for the washing program selected though the washing program selection button 52*i*. The options selection button 56*i* allows the selection of one or more options, preferably "StainTreat", "extra rinse", "wrinkle release", "delay start" and "lock".

The set button 57*i* is used to set various parameters, for example to set the delay time when the "delay start" option is set.

The start/pause button 58*i*, preferably a touch sensitive button, is used to start the washing cycle or to pause the cycle in progress.

The cancel button 59*i*, preferably a touch sensitive button, is used to cancel previous selection/s.

The input devices above described comprise at least two groups of input devices: first input devices, such as the washing program selection button 52*i*, which are operable by the user to select a washing program and second input devices, such as the buttons 53*i*, 54*i*, 55*i*, 56*i* and 57*i* which are operable by the user to select an option for the selected washing program.

Further to input devices, the control panel 50 comprises output devices by means of which information to the user of the features of the machine are given and/or a feedback related to the settings/status of the machine is given.

The output devices of the preferred embodiment illustrated and described herein preferably comprise texts and LEDs.

In different embodiments, output devices may comprise different elements such as displays, alphanumeric displays, lines, images, icons, lights etc., or a combination thereof.

Output devices comprise first output devices that let the user know which are the selectable washing programs that can be performed by the laundry washing machine 1.

First output devices preferably comprise texts, such as "heavy duty", "whitest whites", "normal", "delicates", "20 min fast wash", "rinse & spin" and "clean washer".

Furthermore, output devices comprise second output devices that let the user know which are the selectable options for the selected washing program that can be performed by the laundry washing machine 1.

Second output devices preferably comprise texts, such as "hot", "warm", "cold" and "eco cold" for the washing temperature or "heavy", "normal", "light" and "extra light" for the soil level or the text "StainTreat".

Output devices then comprise further output devices that give a feedback to the user on the settings of the laundry washing machine.

Said further output devices preferably comprise LEDs which are preferably arranged next to said texts, for example a LED 70 is placed at the left of the text "heavy duty".

The LEDs give a feedback to the user on the settings of the laundry washing machine. For example, said LED 70 when ON indicates that the respective "heavy duty" washing program has been selected.

The same applies to the other LEDs of the control panel 50 which are preferably arranged at the left of each of said texts.

As said above, the desired washing program is selected through the washing program selection button 52*i*. Once a washing program has been selected, the user fills with the proper treating agent/s the compartment/s of the dispenser 20.

For example, if the "normal" washing program has been selected the user fills the first compartment 23*a* with a dose of detergent and, optionally, the second compartment 23*b* with a dose of softener and the third compartment 23*c* with a dose of bleach.

The washing cycle is then started by preferably pushing the start/pause button 58*i*. According to the invention, the first output device constituted of the text "heavy duty" comprises a first visual identifier 80.

In the preferred embodiment here illustrated, the first visual identifier 80 comprises a border frame 80*a* surrounding the text "heavy duty". The border frame 80*a* preferably comprises a determined colouring, more preferably has a specific colour, for example a green border frame.

According to the invention, the second output device of the control panel 50 constituted of the text "StainTreat" comprises a second visual identifier 83.

In the preferred embodiment here illustrated, the second visual identifier 83 comprises a border frame 83*a* surrounding the text "StainTreat". The border frame 83*a* preferably comprises a specific colouring which is the same colouring of the border frame 80*a* of the first visual identifier 80, more preferably has the same specific colour, for example green.

According to the preferred embodiment of the laundry washing machine 1 of the invention, the "StainTreat" option is selectable only for the "heavy duty" washing program. Once the "heavy duty" washing program and the "StainTreat" option have been selected, the user fills with the proper treating agent/s the compartment/s of the dispenser 20.

In particular, the user fills the first compartment 23*a* with a dose of detergent and, optionally, the second compartment 23*b* with a dose of softener and the third compartment 23*c* with a dose of bleach. For exploiting the efficiency of the washing cycle, furthermore, the user must fill the fourth compartment 23*d* with a stain remover.

The "StainTreat" option is typically selected by the user when the laundry is very dirty and the additional stain remover is required for the stain treatment phase during the washing cycle.

According to the invention, the same colouring of the boarder frame 80*a* of the text "heavy duty" and of the border frame 83*a* of the text "StainTreat" gives an indication to the user that the "StainTreat" option is selectable only for the "heavy duty" washing program.

The user who necessitates a washing program with a stain treatment phase will be therefore advised to select the "StainTreat" option only after the choice of the "heavy duty" washing program.

Advantageously, by providing the first output device, preferably the text "heavy duty", with a first visual identifier 80 and by providing the second output device, preferably the text "StainTreat", with a second visual identifier 83 wherein both the identifiers 80, 83 comprise the same colouring, the usability of laundry washing machine 1 for the user is improved. The visual identifiers 80, 83, in fact, immediately show the link between the "StainTreat" option and the "heavy duty" washing program.

While the first visual identifier 80 and the second visual identifier 83 are constituted by respective green border frame 80*a*, 83*a*, it has to be underlined that in different embodiments the first visual identifier associated to the first output device and the second visual identifier associated to the second output device can be differently realized.

By way of example, without this implying any loss of generality, the first visual identifier may comprise a coloured background for the text "heavy duty" or the characters themselves of the text "heavy duty" may be coloured, for example green characters.

Analogously, by way of example, without this implying any loss of generality, the second visual identifier may comprise a coloured background for the text "StainTreat" or the characters themselves of the text "StainTreat" may be coloured, for example green characters.

It is also clear that the common colouring which characterizes the first and second visual identifiers may comprise a plain colour or any nuance of colour, for example green colour as described above, or also a particular combination of colours.

It is clear that these generalizations may be applied to all the embodiments described in the present application.

Figure 4:
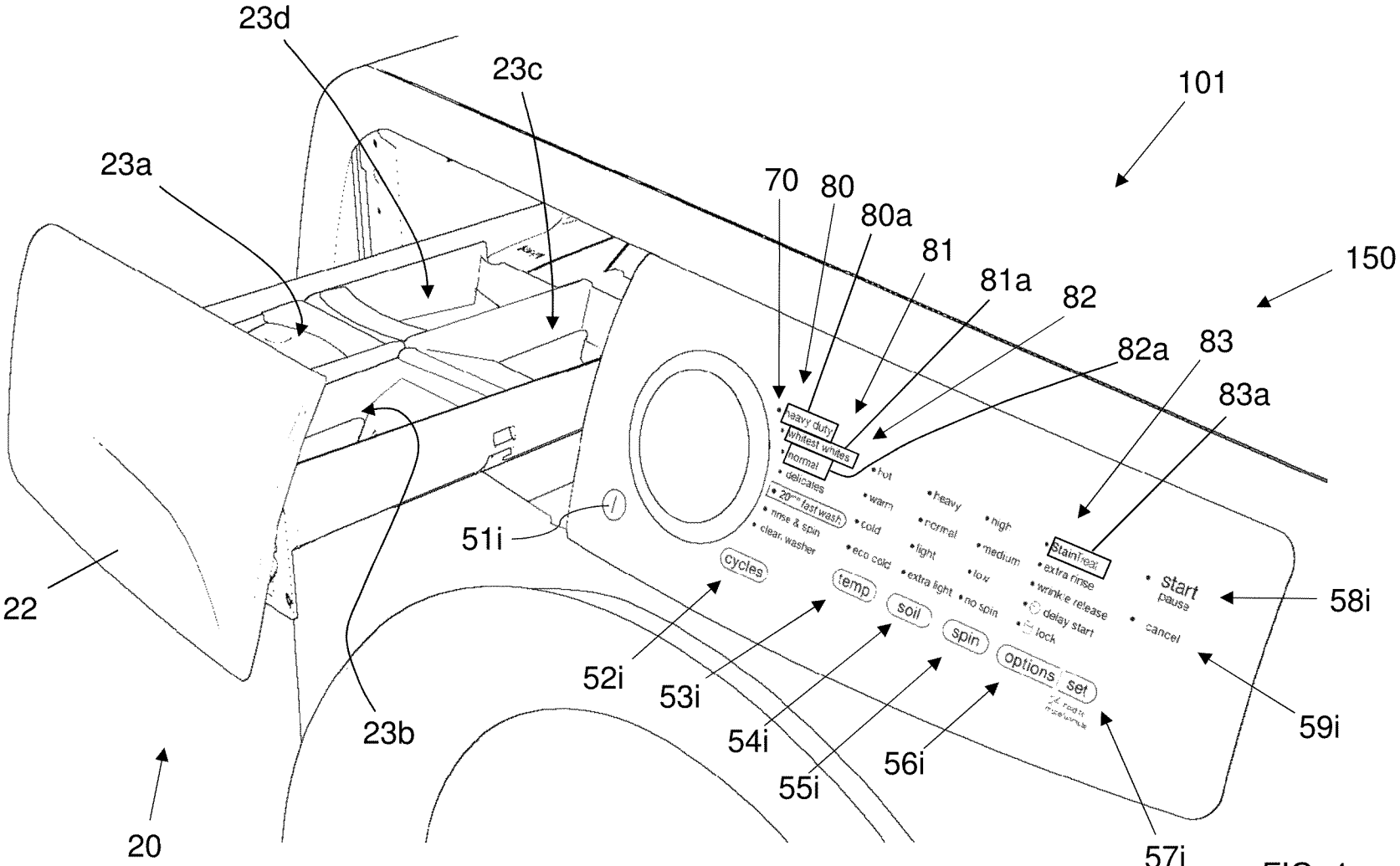
FIG. 4 shows another preferred embodiment of FIG. 3.

With reference to FIG. 4 a laundry washing machine 101 according to a further preferred embodiment of the invention is described.

The laundry washing machine 101 differs from the laundry washing machine 1 previously described in that also the first output devices of the control panel 150 constituted of the texts "whitest whites" and "normal" are characterized by a respective first visual identifier 81 and 82.

In the preferred embodiment here illustrated, each first visual identifier 81, 82 comprises a border frame 81*a*, 82*a* surrounding the respective text "whitest whites" and "normal". Each border frame 81*a*, 82*a* preferably comprises a determined colouring, more preferably the same specific colour, for example a green border frame.

According to this preferred embodiment of the laundry washing machine 101 of the invention, the "StainTreat" option is selectable only for one of the "heavy duty", the "whitest whites" and the "normal" washing programs.

Once the desired washing program and the "StainTreat" option have been selected, the user fills with the proper treating agent/s the compartment/s of the dispenser 20. In particular, the user fills the first compartment 23*a* with a dose of detergent and, optionally, the second compartment 23*b* with a dose of softener and the third compartment 23*c* with a dose of bleach. For exploiting the efficiency of the washing cycle, furthermore, the user must fill the fourth compartment 23*d* with a stain remover.

The washing cycle is then started by preferably pushing the start/pause button 58*i*. According to the invention, the same colouring of the boarder frames 80*a*, 81*a*, 82*a* of the texts "heavy duty", "whitest whites" and "normal" and of the border frame 83*a* of the text "StainTreat" gives an indication to the user that the "StainTreat" option is selectable only for one among the "heavy duty", the "whitest whites" and the "normal" washing program.

The user who necessitates a washing program with a stain treatment phase will be therefore advised to select the "StainTreat" option only after the choice of one among the "heavy duty", the "whitest whites" and the "normal" washing program.

Advantageously, by providing the first output devices, preferably the texts "heavy duty", "whitest whites" and "normal", with a respective first visual identifier 80, 81, 82 and by providing the second output device, preferably the text "StainTreat", with a second visual identifier 83 wherein the identifiers 80, 81, 82, 83 comprise the same colouring, the usability of laundry washing machine 1 for the user is improved. The visual identifiers 80, 81, 82, 83, in fact, immediately show the link between the "StainTreat" option and one of the "heavy duty", the "whitest whites" and the "normal" washing program.

Figure 5:
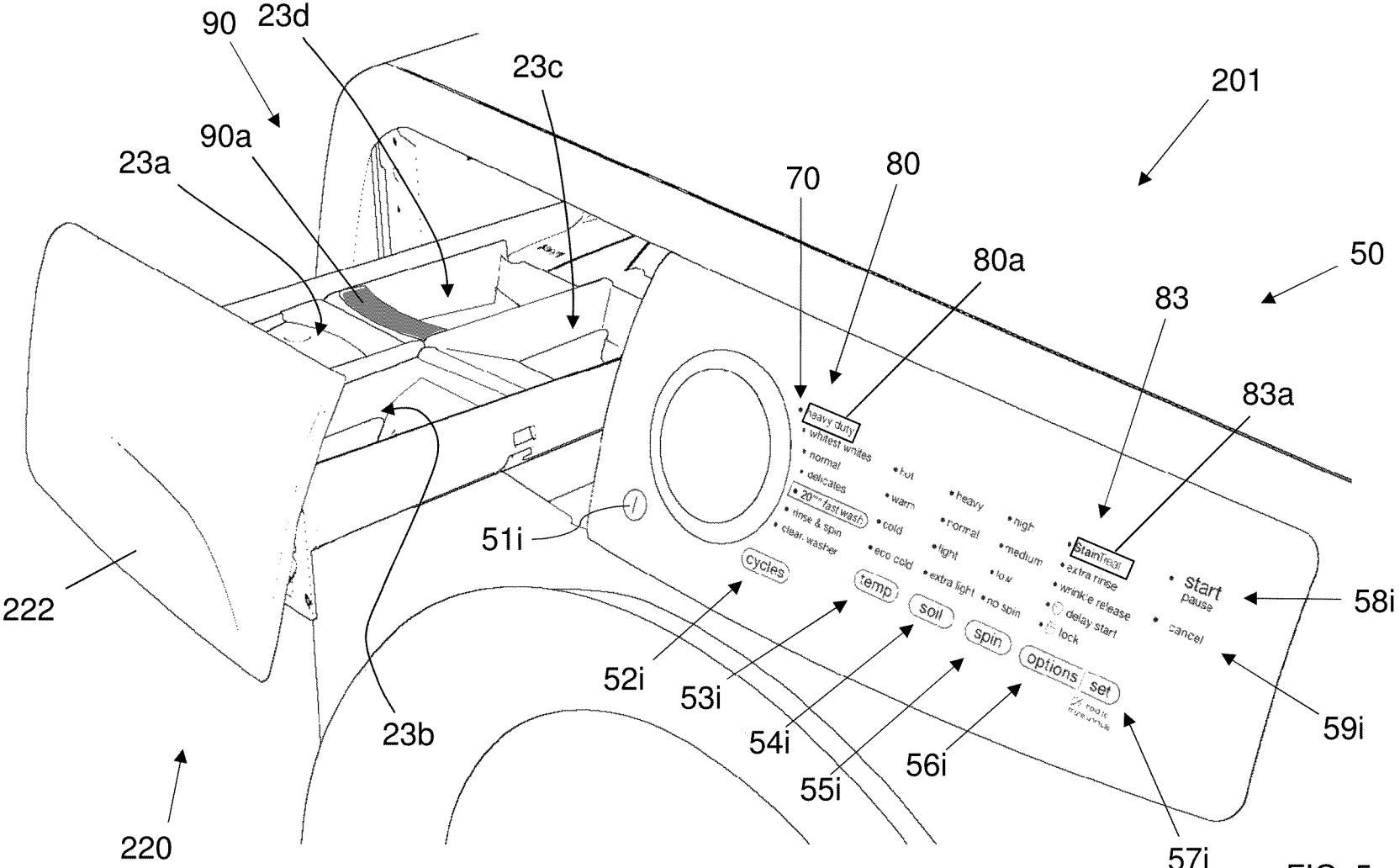
FIG. 5 shows a further preferred embodiment of FIG. 3.

With reference to FIG. 5 a laundry washing machine 201 according to a further preferred embodiment of the invention is described.

The laundry washing machine 201 differs from the laundry washing machine 1 previously described with reference to FIGS. 1 to 3 in that the fourth compartment 23*d* of the removable drawer 222 of the treating agents dispenser 220 is characterized by a third visual identifier 90.

In the preferred embodiment here illustrated, the third visual identifier 90 comprises a tab 90*a*, preferably a plastic tab. The plastic tab 90*a* may be a member connected to the fourth compartment 23*d* or, alternatively, integrally made with it. The tab 90*a* preferably comprises a specific colouring which is the same colouring of the border frames 80*a*, 83*a* of the first and second visual identifiers 80, 83, more preferably has the same specific colour, for example green.

According to the invention, the same colouring of the boarder frames 80*a*, 83*a* of the texts "heavy duty" and "StainTreat" and of the fourth compartment 23*d* gives an indication to the user of a link between the "heavy duty" washing program with the "StainTreat" option and the fourth compartment 23*d*, i.e. that the "StainTreat" option for the "heavy duty" washing program implies the use of the fourth compartment 23*d*.

The user who selects the "heavy duty" washing program with the "StainTreat" option will be therefore advised to fill the fourth compartment 23*d* with an additional dose of treating agent, in the present case a dose of stain remover for the stain treatment phase.

Advantageously, by providing the first output device, preferably the text "heavy duty", with a first visual identifier 80, by providing the second output device, preferably the text "StainTreat", with a second visual identifier 83 and by providing the fourth compartment 23*d* with a third visual identifier 90 wherein all the identifiers 80, 83, 90 comprise the same colouring, the usability of laundry washing machine for the user is improved. The visual identifiers 80, 83, 90, in fact, immediately show the link between the "StainTreat" option, the "heavy duty" washing program and the fourth compartment 23*d*.

While the third visual identifier 90 is constituted by a green tab 90*a*, it has to be underlined that in different embodiments the third visual identifier associated to the compartment can be differently realized.

By way of example, without this implying any loss of generality, the third visual identifier may be realized by colouring the whole compartment, or part of it, for example by colouring the bottom side or the side walls thereof, or by providing a coloured light which illuminates the compartment or any other coloured visual identifier associated to the compartment.

Figure 6:
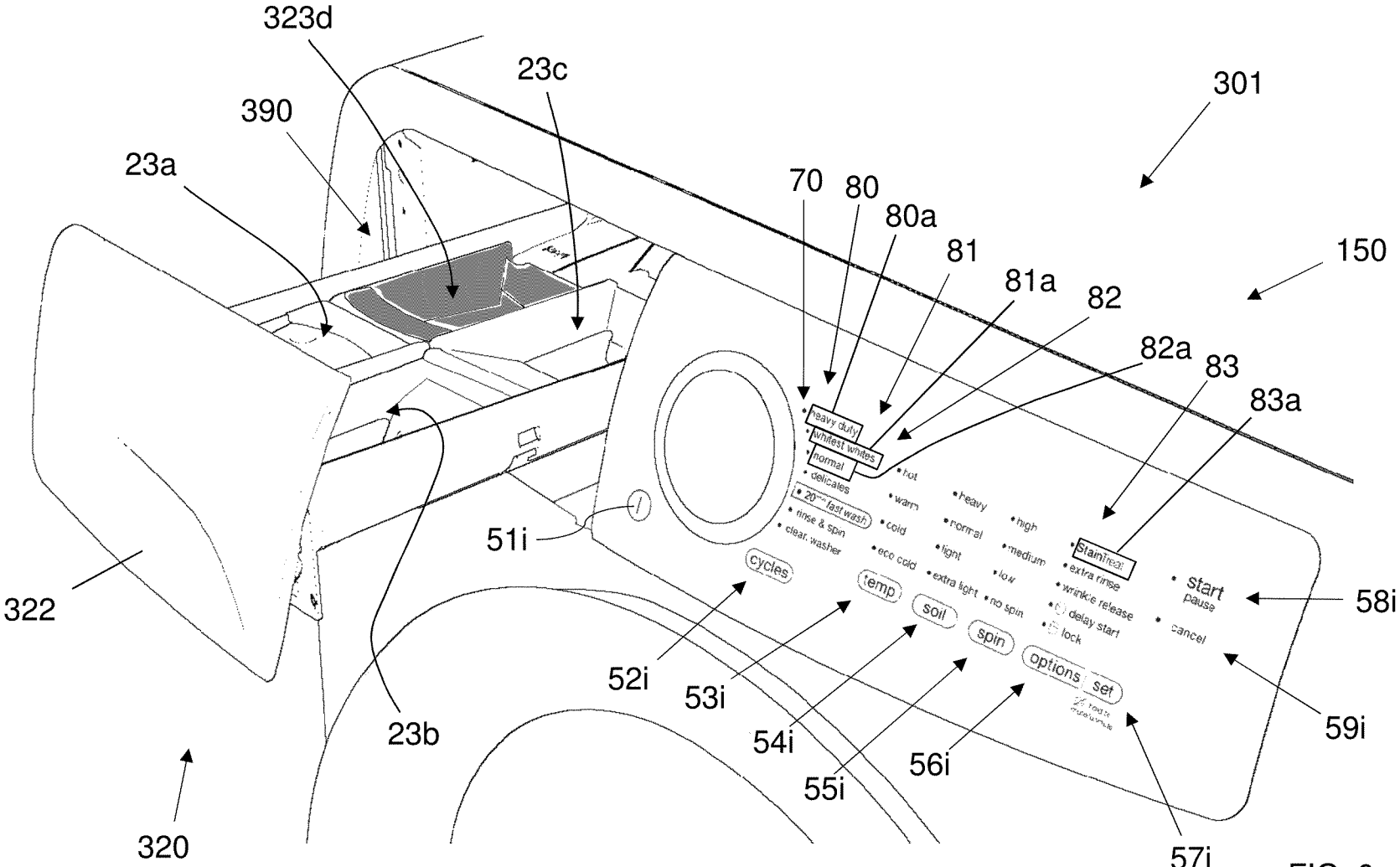
FIG. 6 shows a further preferred embodiment of FIG. 4.

With reference to FIG. 6 a laundry washing machine 301 according to a further preferred embodiment of the invention is described.

The laundry washing machine 301 differs from the laundry washing machine 101 previously described with reference to FIG. 4 in that the fourth compartment 323*d* is characterized by a third visual identifier 390.

In the preferred embodiment here illustrated, the third visual identifier 390 is realized by completely colouring the fourth compartment 323*d*, preferably with a green colour.

According to this embodiment, the same colouring of the boarder frames 80*a*, 81*a*, 82*a* of the texts "heavy duty", "whitest whites" and "normal", of the border frame 83*a* of the text "StainTreat" and of the fourth compartment 323*d*, gives an indication to the user that the "StainTreat" option implies the use of the fourth compartment 323*d*.

The user who selects one among the three washing programs provided with the green visual identifier and the "StainTreat" option will be therefore advised to fill the fourth compartment 323*d* with an additional dose of treating agent, in the present case a dose of stain remover for the stain treatment phase.

Advantageously, by providing the first output devices, preferably the texts "heavy duty", "whitest whites" and "normal", with a respective first visual identifier 80, 81, 82, by providing the second output device, preferably the text "StainTreat", with a second visual identifier 83 and by providing the fourth compartment 323*d* with a third visual identifier 390 wherein all the identifiers 80, 81, 82, 83, 390 comprise the same colouring, the usability of laundry washing machine for the user is improved. The visual identifiers 80, 81, 82, 83, 390, in fact, immediately show the link between the "StainTreat" option, one of the "heavy duty", the "whitest whites" and the "normal" washing program and the fourth compartment 323*d*.

The laundry washing machine 301 according to this preferred embodiment may preferably have various functioning modes.

In a first functioning mode, the user may preferably select one of the three washing programs provided with the green visual identifier, i.e. "heavy duty" or "whitest whites" or "normal", while the "StainTreat" option is not selected.

In this case, the fourth compartment 323*d* is preferably filled with a dose of additional detergent which allows to perform a pre-wash phase during the washing program selected. The fourth compartment 323*d* is therefore suitable to receive a dose of additional detergent for the pre-wash phase, while it is not filled with a stain remover.

In a second functioning mode, the user may preferably select one of the three washing programs provided with the green visual identifier, i.e. "heavy duty" or "whitest whites" or "normal", and also the "StainTreat" option.

In this case, the fourth compartment 323*d* is preferably filled with a stain remover which allows to perform the stain treatment phase during the washing program selected. In the present case, preferably, the use of stain remover in the stain treatment phase has priority over an additional dose of detergent for the pre-wash phase. Therefore, the additional dose of detergent is not inserted in any compartment of the drawer 322 and the pre-wash phase is not performed.

In this case, preferably, the control unit 11 recognizes that both one of the three washing programs provided with the green visual identifier and the "StainTreat" option has been selected and will not execute the pre-wash phase.

Figure 7:
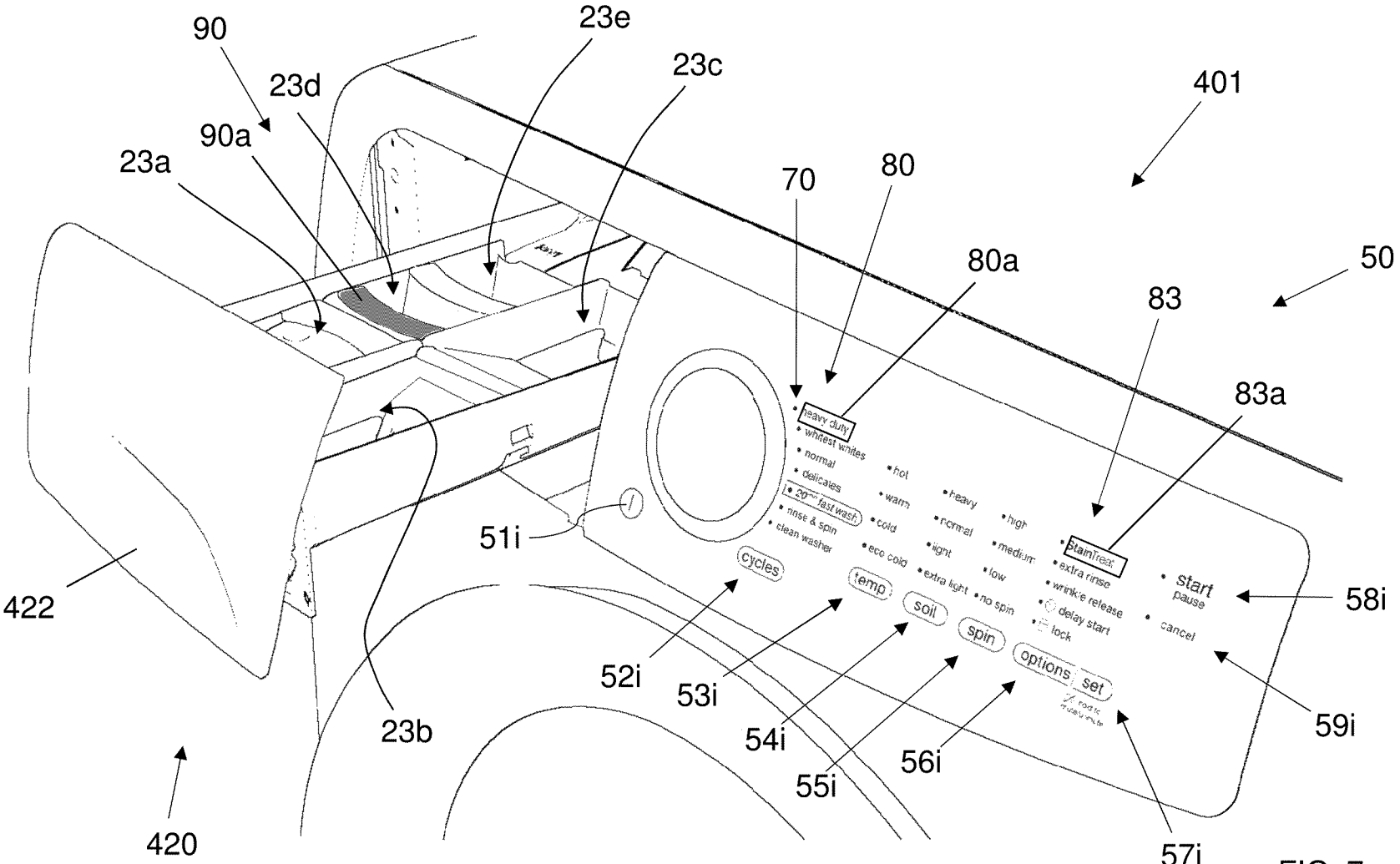
FIG. 7 shows a further preferred embodiment of FIG. 5.

With reference to FIG. 7 a laundry washing machine 401 according to a further preferred embodiment of the invention is described.

The laundry washing machine 401 differs from the laundry washing machine 201 previously described with reference to FIG. 5 in that the removable drawer 422 of the treating agents dispenser 420 further comprises a fifth compartment 23*e*.

The fifth compartment 23*e* is suitable to be filled an additional dose of detergent which allows to perform a pre-wash phase, before the main wash phase, during the washing cycle. The fifth compartment 23*e* is then preferably marked with the text "pre-wash".

According to this preferred embodiment of the invention, the fifth compartment 23*e* is advantageously filled an additional dose of detergent to perform a pre-wash phase for the selected washing program, obviously in case said selected washing program includes the pre-wash phase.

For example, the "heavy duty" program may include a pre-wash phase. Therefore, the fifth compartment 23*e* is advantageously filled with an additional dose of detergent to perform the pre-wash phase.

If also the "StainTreat" option is selected, the user fills the fourth compartment 23*d* with a stain remover, as explained above.

Figure 8:
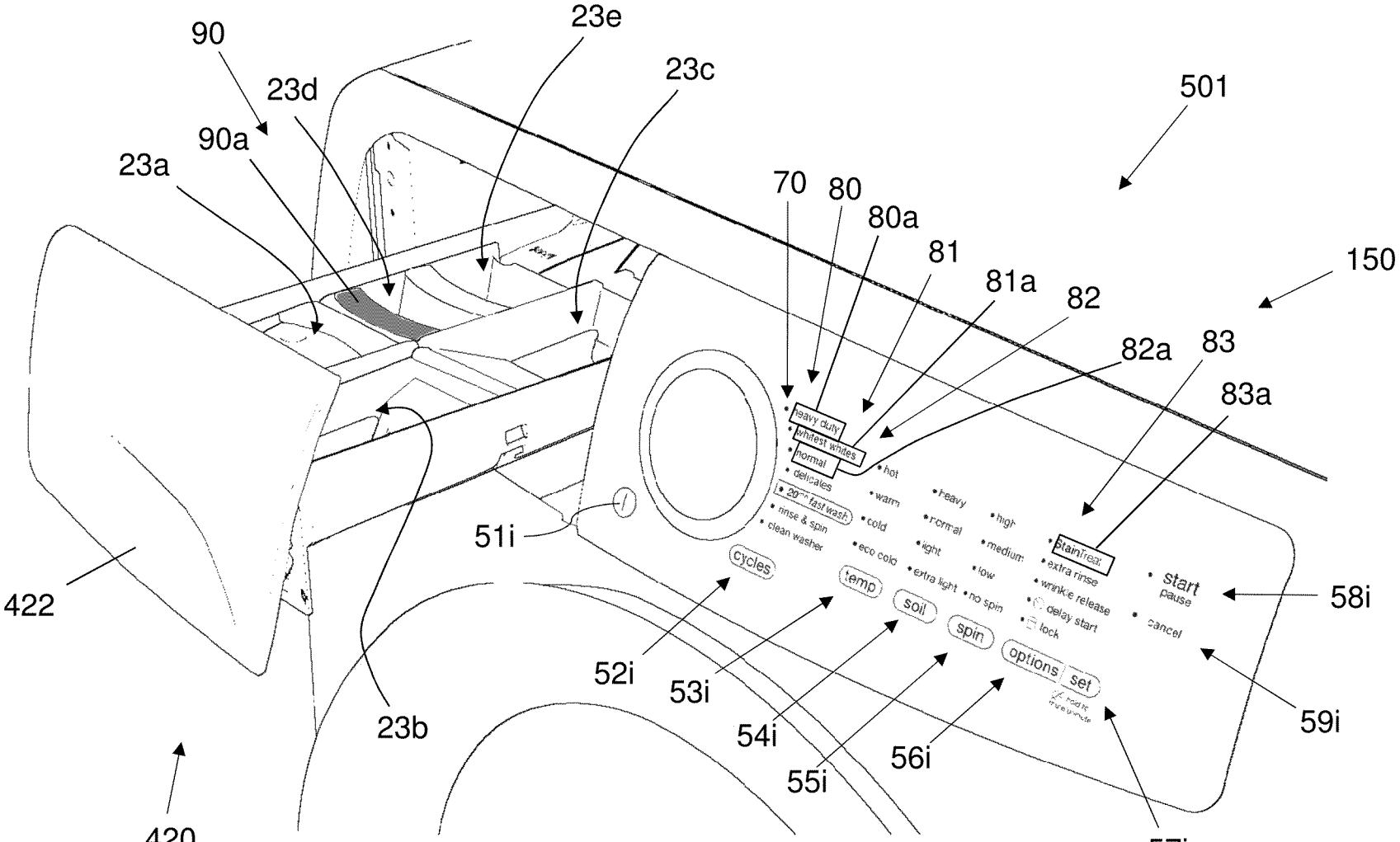
FIG. 8 shows a further preferred embodiment of FIG. 7.

With reference to FIG. 8 a laundry washing machine 501 according to a further preferred embodiment of the invention is described.

The laundry washing machine 501 differs from the laundry washing machine 401 previously described with reference to FIG. 7 in that also the first output devices of the control panel 150 constituted of the texts "whitest whites" and "normal" are characterized by a respective first visual identifier 81 and 82, further to first output device constituted of the text "heavy duty".

This preferred embodiment encompasses all the features previously described with reference to FIGS. 4 and 7.

In particular, the user may fill the fourth compartment 23*d* with a stain remover and the fifth compartment 23*e* with an additional dose of detergent, in case the selected washing program includes the pre-wash phase and the "StainTreat" option is also selected.

In a preferred functioning mode, for example, the user may therefore select one of the three washing programs provided with the green visual identifier, i.e. "heavy duty" or "whitest whites" or "normal", and also select the "StainTreat" option. The user then fills the fourth compartment 23*d* with a stain remover and the fifth compartment 23*e* with an additional dose of detergent. The washing cycle will then be performed with a pre-wash phase using the additional dose of detergent of the fifth compartment 25*e* and a stain treatment phase using the stain remover of the fourth compartment 25*d*.

While the present invention has been described with reference to the stain treatment option, it should be noted that the present invention is not limited to this specific treatment but can be extended to other type of treatment.

It has to be noted that in the preferred embodiments above described, the user preferably fills with the proper treating agent/s the compartment/s of the dispenser after the washing program and the option have been selected.

Nevertheless, in different embodiments, the user may preferably fill with the proper treating agent/s the compartment/s of the dispenser before the selection of the washing program and of the desired option.

Furthermore, it is clear that before the washing cycle is started, preferably by pushing the start/pause button, the laundry load is inserted in the washing drum.

It has thus been shown that the present invention allows all the set objects to be achieved. In particular, it makes it possible to provide a laundry washing machine with features that improves the usability of laundry washing machine for users compared to known laundry washing machines.

It is underlined that the laundry washing machine illustrated in the enclosed Figures is of the front-loading type; however it is clear that the system according to the invention can be applied as well to a top-loading washing machine, substantially without any modification.

While the present invention has been described with reference to the particular embodiments shown in the Figures, it should be noted that the present invention is not limited to the specific embodiments illustrated and described herein; on the contrary, further variants of the embodiments described herein fall within the scope of the present invention, which is defined in the claims.

The invention claimed is:

1. A laundry washing machine connectable to a water mains, the laundry washing machine comprising:

a cabinet supporting a washing drum adapted to receive laundry and a washing tub external to the washing drum;

a treating agent dispenser connectable to the water mains and comprising compartments adapted to be filled with at least one treating agent;

a supply line, fluidly connecting the treating agent dispenser and the washing tub;

a control unit including a processor configured to control functioning of the laundry washing machine; and a control panel comprising:

a first output device including:

a plurality of washing programs, a first text describing a first selectable washing program of the plurality of washing programs, the first text printed on the control panel in a color, or printed on the control panel and highlighted in the color, wherein at least another one of the plurality of washing programs includes text that is not printed or highlighted on the control panel in the color, a first light, controlled by the processor, to illuminate, corresponding to selection of the first selectable washing program, at least one first input device configured to receive a selection of the selectable washing program, at least one second output device, including:

a plurality of options, a second text describing a first selectable option of the plurality of options, the second text printed on the control panel in the color, or printed on the control panel and highlighted in the color, wherein at least another one of the plurality of options includes text that is not printed or highlighted on the control panel in the color, and a second light, controlled by the processor, to illuminate, corresponding to selection of the first selectable option, wherein the color indicates that:

the first selectable option is selectable when the first selectable washing program is selected, and the first selectable option is not selectable when the at least another one of the plurality of washing programs is selected, at least one second input device configured to receive a selection of aof the first selectable option, the first selectable option uses an additional treating agent which has to be inserted in a dedicated compartment of the compartments, wherein in response to receiving the selection of the first selectable washing program, the processor is configured to control the first light to illuminate, indicating that the first selectable washing program is selected, and wherein in response to receiving the selection of the first selectable option, the processor is configured to control the second light to illuminate indicating that the first selectable option is selected.

2. The laundry washing machine according to claim 1, wherein at least one of the first output devices comprises a first visual identifier and the at least one second output device comprises a second visual identifier and wherein the first visual identifier and the second visual identifier have the same colouring.

3. The laundry washing machine according to claim 2, wherein the dedicated compartment also comprises the common visual identifier, and the dedicated compartment comprises a third visual identifier, wherein the first visual identifier, the second visual identifier and the third visual identifier have the same colouring.

4. The laundry washing machine according to claim 2, wherein two or more of the first output devices comprises the first visual identifier.

5. The laundry washing machine according to claim 2, wherein the colouring comprises a colour or a combination of colours.

6. The laundry washing machine according to claim 1, wherein the dedicated compartment also comprises the common visual identifier.

7. The laundry washing machine according to claim 1, wherein the option for the washing program provides for that a stain treatment phase is performed and that the treating agent which is inserted into the dedicated compartment is a stain remover.

8. The laundry washing machine according to claim 1, wherein the washing program provides for that a pre-wash phase is performed and that a dose of detergent is inserted into the dedicated compartment if the option for the selectable washing program is not selected.

9. The laundry washing machine according to claim 1, wherein the first output devices or the at least one second output device comprises one or more of the elements of the group comprising: alphanumeric, texts, lines, images, icons, lights, LEDs displays, alphanumeric displays or a combination thereof.

* * * * *